US005603609A

United States Patent [19]

Kadlicko

[11] Patent Number: 5,603,609

[45] Date of Patent: Feb. 18, 1997

[54] VARIABLE DELIVERY SWASH PLATE PUMP HAVING A PISTON LOCATED SPILL PORT

[75] Inventor: George Kadlicko, Mississauga, Canada

[73] Assignee: Microhydraulics, Inc., Canada

[21] Appl. No.: 516,294

[22] Filed: Aug. 17, 1995

[30] Foreign Application Priority Data

Aug. 19, 1994 [GB] United Kingdom ..... 9416783

[51] Int. Cl.[6] ..... F04B 7/04

[52] U.S. Cl. ..... 417/63; 417/270; 417/289; 417/494; 417/495

[58] Field of Search ..... 417/63, 269, 270, 417/289, 442, 493, 494, 495, 499, 506, 507, 509, 524

[56] References Cited

U.S. PATENT DOCUMENTS

| | | | |
|---|---|---|---|
| 2,588,481 | 3/1952 | Chandler | 417/494 |
| 2,982,216 | 5/1961 | Huber | 417/289 |
| 3,016,018 | 1/1962 | Williams | 417/289 |
| 3,183,847 | 5/1965 | Raymond | 417/499 |
| 3,236,189 | 2/1966 | Pasker | 417/494 |

FOREIGN PATENT DOCUMENTS

| | | |
|---|---|---|
| 484114 | 5/1938 | United Kingdom . |
| 610428 | 10/1948 | United Kingdom . |
| 672173 | 5/1952 | United Kingdom . |
| 738906 | 10/1955 | United Kingdom . |

*Primary Examiner*—Timothy Thorpe
*Assistant Examiner*—Roland G. McAndrews, Jr.
*Attorney, Agent, or Firm*—Ladas & Parry

[57] ABSTRACT

An axial piston pump has multiple pistons and cylinders with a spill port in each piston. A sleeve controls venting from the spill port and an inlet is provided to each cylinder, by way of a check valve from a fluid supply.

8 Claims, 2 Drawing Sheets

VARIABLE DELIVERY SWASH PLATE PUMP HAVING A PISTON LOCATED SPILL PORT

This application claims priority from British patent application No. 9416783.0 filed Aug. 19, 1994. Said document is incorporated herein by reference.

It is of course well known to deliver hydraulic fluid under pressure by means of a pump. It is also well known to vary the delivery of the pump to suit the operating conditions of the hydraulic circuit to which the pump is connected. While the pump has a fixed capacity, it is possible to vary the flow rate by adjusting the rotational speed of the pump but this is generally inconvenient where the motor used to operate the pump is designed to rotate at a constant speed such as, for example, an electric motor. Accordingly, where variable hydraulic flow rate is required from a fixed capacity pump, it is usual to utilize a hydraulic valve in the circuit to control the flow rate. This usually means, however, that fluid under pressure is diverted across a pressure release valve causing significant heating of the hydraulic fluid and increased energy consumption.

Variable capacity hydraulic pumps utilize a change in the stroke of the pump to vary the flow rate. Typically this is provided by means of an adjustable swash plate that is adjustable about an axis transverse to the axis of rotation and acts upon the pistons to vary their stroke. Similar arrangements are provided in which the pistons are connected through universal joints to a rotating head of the pump and the orientation of the head relative to the pistons may be adjusted. While such pumps have been widely used, the adjustability of the pumps are mechanically complex and are difficult to adjust where low or negligible flow rates are required. There is, therefore, the need for a variable delivery hydraulic pump which obviates or mitigates the above disadvantages and yet is economical to produce and mechanically simple.

According to the present invention, therefore, there is provided a hydraulic pump having a piston reciprocable within a cylinder. Fluid is provided to the interior of the cylinder from an inlet and a spill port is provided on the piston. An adjustable sleeve is arranged on the cylinder and may be adjusted to cover the spill port as the piston reciprocates within the cylinder. By varying the position at which the spill port is covered, the portion of the stroke during which high pressure fluid is delivered from the cylinder is adjusted, allowing for adjustable delivery from the pump. During the portion of the stroke that the spill port is uncovered, fluid is expelled from the cylinder under normal low pressure conditions.

It is preferred that a plurality of pistons are disposed around an axis and the sleeves are commonly adjusted by a controller piston acting conjointly on the sleeves.

Figure 1:
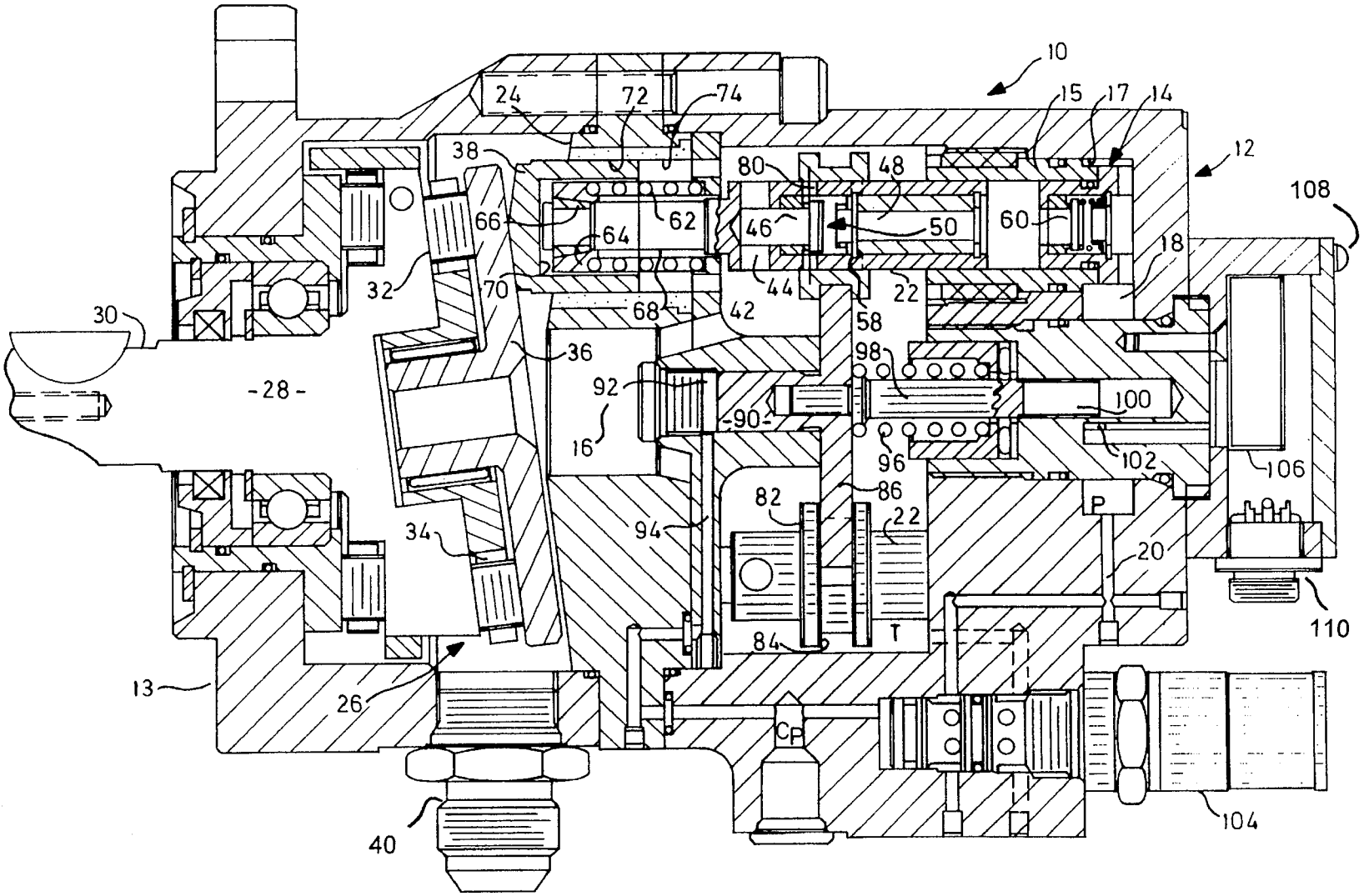
Figure 2:
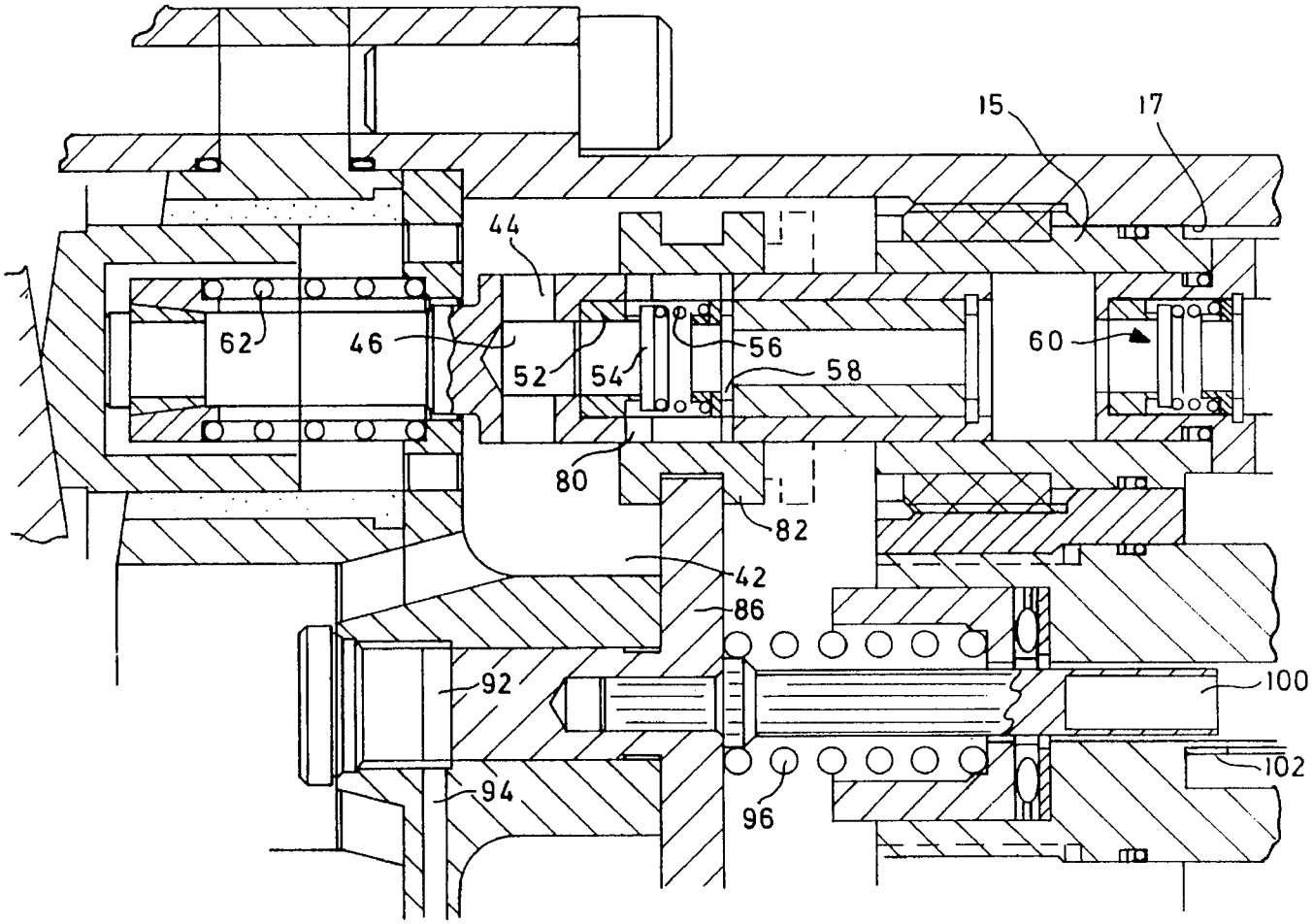

An embodiment of the invention will now be described by way of example only, with reference to the accompanying drawings in which FIG. 1 is a side view, partly in section, of a pump assembly; and FIG. 2 is an enlarged view of the pumping elements shown in FIG. 1.

Referring therefore to FIG. 1, a pump generally indicated 10 has a cylinder block 12 and a drive housing 13. The block 12 is formed with a number of cylinders 14 circumferentially spaced about a central axis indicated at 16. The cylinders 14 are connected by internal galleries 18 to an outlet 20. Each of the cylinders 14 is formed by a cylindrical bush 15 that is located in a bore 17 in the block 12.

A piston 22 is slidably received in each of the cylinders 14 to reciprocate parallel to the axis 16. The pistons 22 are slidably supported by a partition 24 and are caused to reciprocate through a drive 26. The drive 26 includes a crankshaft 28 having a driveshaft 30 connected to a motor (not shown). The crankshaft 28 has an inclined drive face 32 supporting a bearing ring 34 that carries a stationary swashplate 36. The swash plate 36 engages tappets 38 carried by the pistons 22 so that as the driveshaft 30 rotates, the pistons 22 are caused to reciprocate within the cylinders.

Hydraulic fluid is supplied through a port 40 and internal ducts to a gallery 42 provided within the housing 13 adjacent cylinder block 12. The gallery 42 communicates with a cross drilling 44 provided in the piston 22 and communicating with a feed gallery 46 extending axially along the piston 22. Piston 22 includes a counterbore 48 defined by an internal sleeve 49 extending to the feed gallery 46 and having a check valve assembly 50 located at the remote end. Check valve assembly 50 includes an annular seat 52 and a disk valve member 54 that is biased against the seat 52 by a spring 56. The spring 56 is retained by a snap ring 58 so that fluid introduced through the cross drilling 44 and feed 46 may flow past the disk 54 and into the cylinder 14. Flow from the cylinder 14 to the supply duct 18 is regulated by a check valve 60.

The piston 22 is biased away from the duct 18 by means of a spring 62 that acts between the partition 24 and a retaining disk 64. The disk 64 is secured through split collar 66 to a drive rod 68 formed as an extension of the piston 22. The rod 68 bears against an internal surface 70 of the tappet 38. The tappet 38 is slidably supported on its radially outer surface 72 in a bore 74 of the housing 13. The head of tappet 38 is conical to provide a line of contact with the swashplate 36.

As can best be seen in FIG. 2, the piston 22 includes radially extending ducts 80 which provide a spill path for hydraulic fluid from the cylinder 14. Ducts 80 are disposed circumferentially around the piston 22. An annular sleeve 82 is mounted on each of the pistons 22 with an outwardly directed channel 84 provided on its circumference. The channel 84 is engaged by a radial disk 86 on a stroke adjustment member generally indicated 88 which has a control piston 90 extending from the disk 86 into a control cylinder 92. Control pressure is supplied to the control cylinder 92 through a control duct 94 and the adjustment member 88 is biased by means of spring 96 to minimize the volume of the chamber 92. An indicator rod 98 projects from the control piston 90 into a bore in the housing 13. The rod 98 carries a magnetic insert 100 which co-operates with a Hall effect sensor 102 to provide a position feedback signal indicative of the position of the member 90. The pressure supplied to control cylinder 92 is modulated by a proportional pressure control valve 104 which receives a control signal from an electronic control module 106. The module 106 is located in a housing 108 connected to the cylinder block 12 and receives internal control signals from the position sensor 102 and external control signals via a coupling 110. The module 106 also provides a control signal to the valve 104.

In operation, rotation of the driveshaft 30 causes the pistons 22 to reciprocate within the cylinders 14. As the piston 22 moves to reduce the volume of the cylinder 14, fluid is expelled through the spill duct 80 to sump. Check valve 60 inhibits flow to the supply duct 18 until sufficient pressure is generated within the cylinder 14 to displace the check valve.

As the piston 22 telescopes into the cylinder 14, the spill duct passes within the sleeve 82 to inhibit further flow through radial duct 80. Continued inward movement of the piston 22 causes pressure to rise in the cylinder 14 and fluid to be supplied to the duct 18. As the piston stroke is reversed, the check valve 60 prevents return flow from the duct 18 and check valve 50 opens to allow flow from the supply gallery 40 through the cross drilling 44 and supply duct 46 into the bore 48. It will be noted that the check valve 50 may open as soon as the pressure in the cylinder 14 drops below that in the supply gallery which is as soon as the stroke is reversed. This provides a maximum period in which the fluid in the cylinder is replenished and avoids negative pressure on the cylinder 14. The fluid is supplied to the cylinders 14 from the interior of the housing 13 so that a ready supply of fluid is available.

The point at which the sleeve 82 closes the supply duct 80 is determined by the position of the control member 90. The admission of fluid pressure through the control duct 94 into the chamber 92 causes axial displacement of the adjustment member 90 to carry the sleeve 82 axially along the piston 22. The pressure in duct 94 is controlled by the valve 104 in response to control signals processed by the control module 106. As the sleeve 82 is moved against the spring 96 toward the cylinder block 12, the spill duct 80 is closed later in the stroke, causing a reduced volume of fluid to be displaced into the supply duct 18 for each stroke of the piston. In the solid line position shown in FIG. 2, the sleeve 82 is in a maximum displacement position with the minimum displacement being indicated in ghosted outline.

With the arrangement shown, the surplus fluid is spilled at low pressure to avoid overheating of the fluid and excess energy consumption. The radial forces imposed on the piston through the crankshaft are absorbed by the bearings provided at 72 in the housing 13, allowing free sliding movement of the pistons 22. The capacity of the pump 10 is indicated by the position sensor 102 to provide flexibility in control of the pump 10. Flow control of the pump 10 may be obtained by monitoring the signal from the sensor 102 and adjusting the sleeve 82 to maintain a preset value from the sensor 102.

Pressure control may be obtained by monitoring the pressure delivered to supply 20 and adjusting the control pressure in chamber 92 to maintain the maximum flow without exceeding the pressure limit.

By combining the two control functions, a horsepower control can be obtained through module 106 in which either pressure or flow can be controlled and the other parameter varied to limit the horsepower absorbed.

In each case, the sleeve 82 may be adjusted to provide accurate control of the flow rate with excess flow being discharged at low pressures. The adjustment of displacement is performed independently of the mechanical loads imposed on the drive to permit more accurate control under a wide variety of conditions. The pistons 22 are supported in the block 12 and partition 24 with radial loads being absorbed by the bore 74.

The low pressure fluid is circulated through the pump housing to assist cooling of the pump.

We claim:

1. A variable capacity hydraulic pump having a plurality of pistons reciprocal within a respective one of a plurality of cylinders, each cylinder having associated therewith an inlet to supply fluid to said cylinder and an outlet to deliver fluid from said cylinder to a consumer, said inlet including a check valve located within each piston between a supply of fluid and said cylinder and operable to inhibit flow of fluid from said cylinder; a spill port in each of said pistons operable to vent fluid from respective ones of said cylinders during reciprocation of said pistons, and a sleeve slidably mounted on each of said pistons, to co-operate with a respective one of said spill ports to control venting of fluid from said cylinders, said sleeves being conjointly adjustable relative to respective ones of said cylinders, to vary the portion of the stroke of the pistons during which said spill ports are covered by said sleeves and thereby vary the volume of fluid delivered to respective ones of said outlets.

2. A variable capacity pump according to claim 1 wherein said plurality of pistons and cylinders are reciprocable along parallel axes.

3. A variable capacity pump according to claim 2 wherein said sleeves are adjustable by co-operation with an adjustment member movable along an axis parallel to the axis of reciprocation of the piston in the cylinder.

4. A variable capacity pump according to claim 3 wherein a position sensor is associated with said adjustment member to provide a signal indicative of the position of the adjustment member relative to the cylinder.

5. A variable capacity pump according to claim 1 wherein said sleeve is positioned to maintain said spill port covered when said cylinder is at a minimum capacity and any venting thereof occurs when said cylinder is at a maximum capacity.

6. A variable capacity pump according to claim 1 wherein said supply of fluid is located within a housing containing said cylinders.

7. A variable capacity pump according to claim 6 wherein said check valve is disposed in an axial duct in said cylinder and fluid is supplied thereto by radial ports in said piston.

8. A variable capacity pump according to claim 7 wherein said radial ports communicate with the interior of said housing.

* * * * *